United States Patent [19]

Takenoya

[11] Patent Number: 4,598,655

[45] Date of Patent: Jul. 8, 1986

[54] DRIVING DEVICE OF AN EMBROIDERY FRAME IN A ZIGZAG SEWING MACHINE

[75] Inventor: Hideaki Takenoya, Tokyo, Japan

[73] Assignee: Janome Sewing Machine Co. Ltd, Tokyo, Japan

[21] Appl. No.: 594,776

[22] Filed: Mar. 27, 1984

[30] Foreign Application Priority Data

Mar. 30, 1983 [JP] Japan ..... 58-52766

[51] Int. Cl.[4] ..... D05C 9/04; D05B 21/00

[52] U.S. Cl. ..... 112/103; 112/121.12

[58] Field of Search ..... 112/121.11, 121.12, 112/102, 103, 86, 78, 90, 121.15, 300

[56] References Cited

U.S. PATENT DOCUMENTS 3,734,038 5/1973 Taketomi ..... 112/102
3,905,315 9/1975 Sasaki ..... 112/102
4,114,545 9/1978 Manabe et al. ..... 112/121.12
4,280,420 7/1981 Nishida et al. ..... 112/121.12

FOREIGN PATENT DOCUMENTS

WO82/04076 11/1982 PCT Int'l Appl. ..... 112/121.12

*Primary Examiner*—Werner H. Schroeder
*Assistant Examiner*—Joseph S. Machuga
*Attorney, Agent, or Firm*—Michael J. Striker

[57] ABSTRACT

An automatic embroidery frame drive device used in an automatic embroidery sewing machine which produces embroidery stitches on a fabric held by an embroidery frame comprising a 1st, a 2nd and a 3rd electromagnetic actuator which is disposed at a stationary side of the embroidery frame drive device and a plurality of wires for transmitting movement of said electromagnetic actuators, so that the embroidery frame is controlled in X and Y directions.

2 Claims, 15 Drawing Figures

(a) Floppy
(b) Drive circuit
(c) Sensor of upper shaft
(d) Speed control circuit
(e) Main motor
(f) CRT Drive circuit
(g) Key operate
(h) Zigzag motor
(i) 1st motor
(j) 2st motor
(k) 3st motor

DRIVING DEVICE OF AN EMBROIDERY FRAME IN A ZIGZAG SEWING MACHINE

FIELD OF THE INVENTION

This invention relates to an automatic embroidery sewing machine, especially to a driving device of an embroidery frame, which produces embroidering patterns such as Chinese characters, Japanese letters, English or figures by means of a combination of a zigzag sewing machine and an embroidery frame.

BACKGROUND OF THE INVENTION

In an automatic embroidery sewing machine, embroidering data are stored in a memorizing medium such as a floppy disc etc., and signals of said data are read out by a phase signal per each rotation of the sewing machine, and two electromagnetic actuators which provide control in an X direction and control in a Y direction, are driven in accordance with said signal at a phase where a needle is above a fabric to be stitched, to provide X and Y controls on the embroidery frame and form stitches on the fabric supported by the embroidery frame. The above mentioned conventional embodiments are roughly classified into the following two kinds.

a. The needle reciprocates vertically only without moving in amplitude, and b. The needle moves in amplitude and vertical reciprocation.

When an embroidering pattern is, as shown in FIG. 1(*a*), produced by the automatic embroidery sewing machine of the above (a) type, the embroidery frame having large quality and quantity of inertia should be moved in the X and Y directions concurrently in accordance with signals of said pattern stitching data within a certain phase where the needle is above the fabric. Therefore, the maximum rotation speed of the sewing machine is limited to about 600 rpm due to the responding limit of said electromagnetic actuator, resulting in a problem involving working efficiency.

Further problems are large vibrations and noises caused by the quality and quantity of the inertia of the embroidery frame even in the lower rotation speed.

In addition, rapid movement as mentioned above is not preferable in view of durability, and generates play in members composing the device that drives the embroidery frame consequently making vibrations and noises larger, so that stitched patterns are deformed, and responsibility is underestimated in view of the durability in the members.

An automatic embroidery sewing machine of the above (b) type is to improve each of the above mentioned problems involved in the (a) type. A zigzag generator of the automatic embroidery sewing machine of the (b) type is composed in outline as seen in FIG. 2. In FIG. 2, a triangular cam 1 is fixedly mounted on a shaft 2 which has ½ the rotation speed of an upper shaft of the sewing machine. A fork member 3 to be turned by the angular cam 1 is controlled by a controller 5 which is obliquely controlled by a zigzag width control motor 4, and gives zigzag action to a needle bar supporter 6 and a needle bar 7.

Since the zigzag width control motor 4 does not directly turn the needle bar 7 but indirectly controls it by changing the obliqueness of the controller 5 when the zigzag width is changed, the motor 4 has the equivalent value to controlling members of smaller inertia, and especially letters which in the embroidering patterns do not require rapid changings in the embroidering width and the motor 4 could follow the high speed rotation of the sewing machine.

For producing the stitching pattern as shown in FIG. 1(*a*) by the automatic embroidery sewing machine of the (b) type, if X and Y directions are determined and the zigzag direction is made in Y direction, it is sufficient that the needle moves relatively and straightly on the center of the embroidery width, and the movement of the embroidery frame may be reduced as small as possible. Therefore this kind of the automatic embroidery sewing machine could follow a high speed of around 2000 rpm, and the durability of the driving device of the embroidery frame is satisfactory.

Unfortunately, the automatic embroidery sewing machine of the (b) type could not satisfy varieties of stitchings. For producing the embroidering patterns of a shape as shown in FIG. 1(*b*), it is not preferable to limit stitching shapes in spite of various stitchings, and in the present case consideration is taken with regard to formation of the pattern shown in FIG. 1(*b*). Herein, a problem arises regarding the case of composing stitchings oriented in directions varying by 90°. As the obliquness between a standard direction (i.e. Y direction and same direction as the zigzag direction) and the stitching direction becomes larger, the zigzag movement is not available. Especially, when the standard direction and the stitching direction are at an angle 90° from each other as seen in a lateral part of "T" in FIG. 1(*b*), the needle is in the same effect in the straight movement, and the embroidery frame should be moved at the small distance in the Y direction and at the large distance in the X direction per each of stitchings. Therefore, in the stitching condition, this is the same as the (a) type sewing machine and could not follow the high rotation of 2000 rpm, and if rotation were 600 rpm as the (a) type, the same problems would appear as therein.

SUMMARY OF THE INVENTION

In the automatic embroidery sewing machine incorporated with the embroidery frame control in the zigzag sewing machine which moves the needle in the amplitude, it is a first object of the invention to provide rotation control of the embroidery frame in addition to the conventional controls in the X and Y directions, and to control rotation of the embroidery frame around an optional point on a fabric held by the embroidery frame by composition of said rotation control and the controls in the X and Y directions, so that desired embroidering patterns of composite in the stitching directions.

It is a second object of the invention to make inertia in the movable embroidery frame small by providing three motors which control said frame at the stationary part of the driving device of the frame, and make the movement of the embroidery frame in the high rotation of the sewing machine smallest with respect to the embroidering pattern a composite in the stitching directions by adding rotation control to the control of the frame of the conventional automatic embroidery sewing machine, and make low vibrations and noises at controlling the embroidery frame and increase durability by transmitting the movement through a wire connection, so that the embroidering is performed at high speed.

It is a third object of the invention that when the embroidery frame is rotated around the optional stitching point, the sewing machine is stopped and the three motors bear the controls and the at least two motors bear X and Y directions at high rotation of the sewing machine, and the inertia of the frame is made small as mentioned above, so that the motor may be made small in size.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 3:
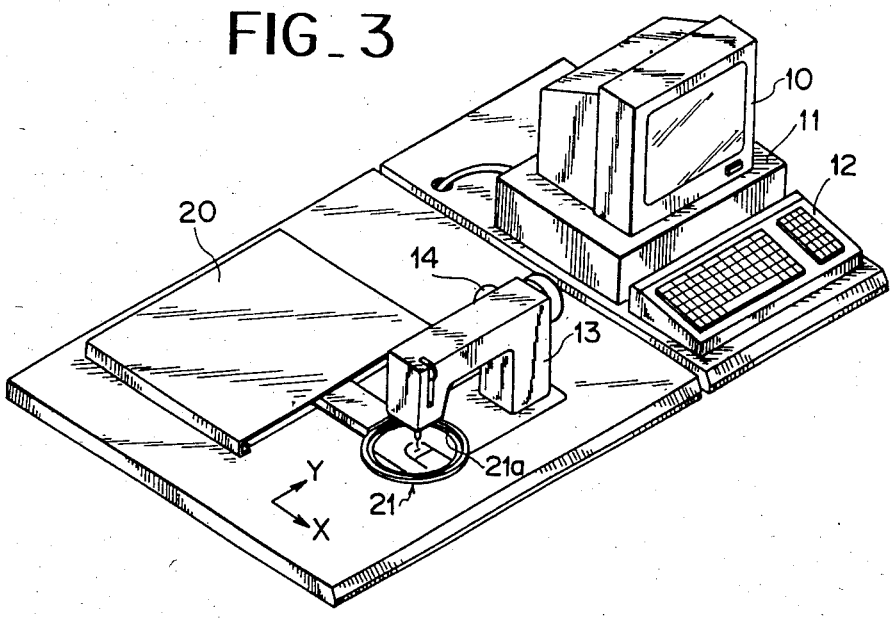
FIG. 3 is an outlined perspective view of the automatic embroidering sewing machine.

Referring to the attached drawings, in FIG. 3, the reference numeral 10 is a CRT display, 11 is a control circuit box for housing various driving circuits, and 12 is a key operating portion to be operated in cooperation with CRT display 10 for carrying out enlargement and reduction of an embroidery frame, editing works such as direction or positioning of the embroidering patterns, calling out the data of the embroidering pattern stored in a memory medium such as a floppy disc, starting and stopping the embroidering operation. 13 is a zigzag sewing machine which is controlled by a zig-zag control motor 14. 20 is an embroidery frame driving device, 21 is an embroidery frame holder, and 21*a* is an embroidery frame.

Figure 4:
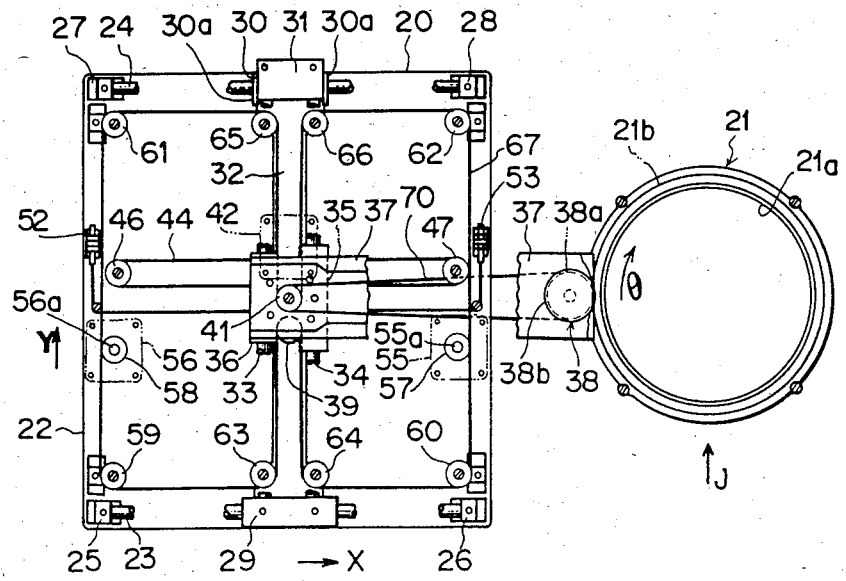
FIG. 4 is a plan view showing a main part of a driving device of the embroidery frame.

The emboridery frame driving device 20 will be referred to regarding a structure thereof. In FIG. 4, the numeral 22 is a basic plate for setting up the embroidery frame driving device 20 as a unit. 23 and 24 are guide shafts screwed to bosses 25, 26 and 27, 28 which are secured on the base plate 22.

The guide shaft 23 is provided with a moving body 29 which moves in an X direction via a ball bearing, and similarly the guide shaft 24 is disposed with a moving body 30 which moves in a Y direction.

Figure 7:
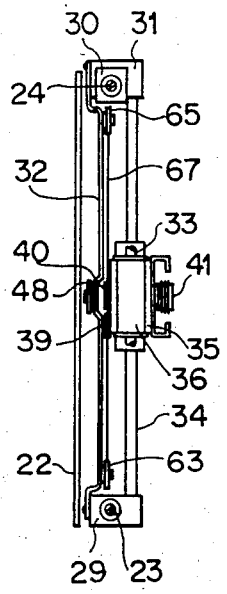
FIG. 7 is a view seen from an arrow K in FIG. 6.

A fork body 31 holds the moving body 30 as shown in FIG. 7, and is regulated by a pair of flanges 30*a* with respect to movement in the X direction but free in movement in the Y direction. The fork body 31 and the moving body 29 are connected via a moving body 32 so that they both move in the X direction, and any error in parallelism between the guide shafts 23 and 24 is absorbed by the fork body 31.

The moving body 29 and the fork 31 are secured with two guide shafts 33, 34 at their end portions, and the guide shaft 34 is provided with XY moving body 35 (FIG. 6) via a ball bearing, movable along the guide shaft 34. A fork portion formed in the XY moving body engages a moving body 36 which is disposed on the guide bearing shaft 33 via a ball bearing, and absorbs error in parallelism between the guide shafts 33 and 34 as mentioned above. The XY moving body 35 is secured on its upper surface with one end of an arm member 37, and the arm member 37 is connected at its other end to the embroidery frame holder 21, and is rotatably supported with a rotary member 38 which is integrally defined with a pulley 38*a* and a gear 38*b*. The gear 38*b* of the rotary member 38 is in mesh with a gear 21*b* defined in the embroidery frame 21*a* which is rotatable with respect to the embroidery frame holder 21.

Figure 6:
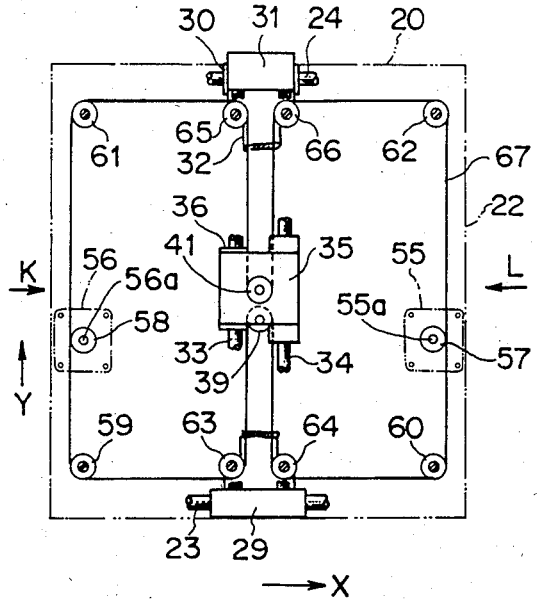
FIG. 6 is a plan view showing control systems by a second and a third motors of the embroidery frame driving device.

The XY moving body 35 is, as shown in FIGS. 6 and 7, rotatably provided with a pair of rotary bodies 39 and 40. The arm member 37 provided on the surface of the body 35 is disposed thereon with a rotary body 41 which is rotated together with the rotary body 40, and rotation of the rotary body 41 is transmitted to the embroidery frame 21*a*.

Figure 9:
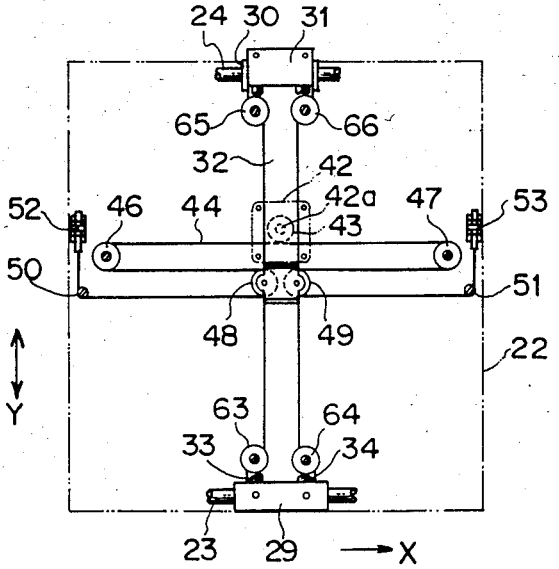
FIG. 9 is is a view showing a control system by a first motor of the embroidery frame driving device.
Figure 10:
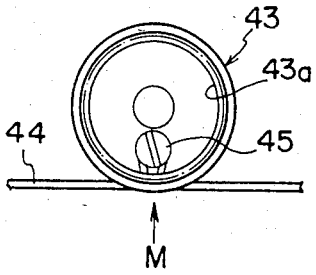
FIG. 10 is a plan view of a pulley for the 1st motor.
Figure 11:
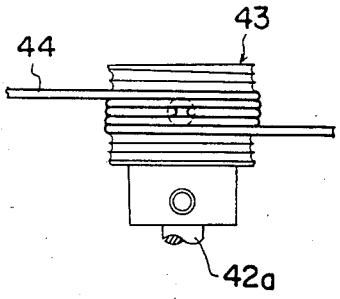
FIG. 11 is a view seen from an arrow M in FIG. 10.

In FIG. 9, the base plate 22 is furnished centrally on a lower surface thereof with a 1st motor 42 which is a 1st electromagnetic actuator, and an output shaft 42*a* protrudes an upper surface of the base plate 22 and is secured with a pulley 43 which is coiled with a wire 44 for transmitting power as seen in FIG. 11. A part of the wire 44 passes the side hole of a pulley 43 and is brought in a loop like shape into a hollow portion 43*a* as in FIG. 10 and is fixed on the pulley 43 with a screw 45. The wire 44 is expanded symmetrically and turns back around idlers 46, 47 rotatably pivoted on the base plate 22, and subsequently turns around idlers 48, 49 rotatably pivoted on the lower surface of the moving body 35, and further the wire 4 is secured at its both ends under tension to stoppers 52, 53 via pins 50, 51. Attention is paid to make slipping in relation with the pulley 43. Since the wire 44 is expanded from the both sides, internal force of the wire is counterbalanced and is not a load to rotation.

In FIG. 6, there are provided a 2nd motor 55 which is a 2nd electromagnetic actuator on the right side of the lower surface of the base plate 22 and a 3rd motor 56 which is a 3rd electromagnetic actuator on the left side thereof. Output shafts 55*a*, 56*a* of the motors 55, 56 respectively protrude the upper surface of the base plate 22, and are provided with pulleys 57 and 58.

In FIG. 4, there are rotatably pivoted rotary bodies 59, 60, 61, 62 at the four corners on the upper surface of the base plate 22, and on an upper surface of the moving body 32 there are rotatably pivoted bodies 63, 64, 65, 66.

Figure 5:
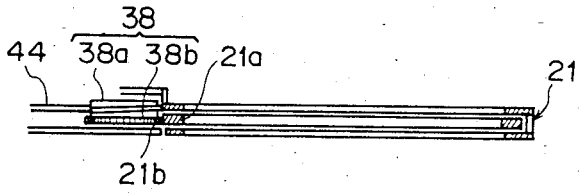
FIG. 5 is a view seen from an arrow J in FIG. 4.
Figure 8:
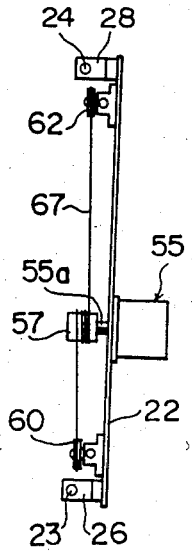
FIG. 8 is a view seen from an arrow L in FIG. 6.
Figure 12:
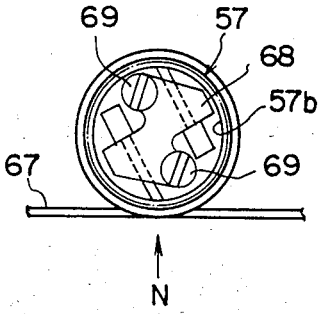
FIG. 12 is a plan view of a pulley for the 2nd motor.
Figure 13:
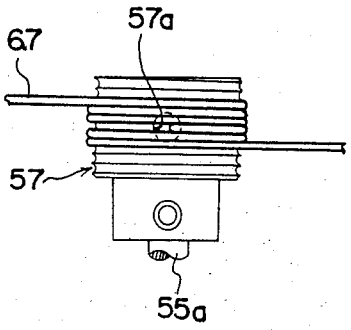
FIG. 13 is a view seen from an arrow N in FIG. 10.

As seen in FIGS. 8 and 13, the wire 67 is coiled on a pulley 57, and is guided in order by the rotary bodies 62, 66, 40, 65, 61 from the pulley 57 and coiled on the pulley 58 several times, and returns to the pulley 57 in order by the rotary bodies 59, 63, 39, 64, 60. As shown in FIG. 12, the wire 67 is brought at both its ends into a hollow portion 57*b* via a side hole 57*a* (FIG. 13) formed in the pulley 57 and secured via a metal 68 to the pulley 57 by screws 69. The wire 67 is effected with tension, and attention is paid not to allow slipping with respect to the rotary body 40. A wire 70 is, as shown in FIG. 5, coiled several times on the pulley 38*a* of the rotary member 38, and is brought into and coiled several times on the rotary body 41.

According to the invention, since the 1st motor 42 controlling the embroidery frame 21*a*, the 2nd motor 55 and the 3rd motor 56 are provided on the base plate 22 of the embroidery frame driving device, inertia of the embroidery frame may be small. The actuation is mainly transmitted via the wire so that noises or vibrations when controlling the embroidery frame may be lower than gears or the like.

A further reference will be made to control in X and Y directions and rotations of the embroidery frame 21*a*. In the following description, the direction indicated by X and Y arrows are normal directions of X and Y axes, and the rotation is normal in the clockwise direction.

The control in X the direction will be explained with reference to FIG. 9. When the 1st motor 42 is normally rotated, the wire 44 is coiled by a side part of the rotary body 47, and it is uncoiled to a side of the rotary body 46 by the coiled part of the wire, and the moving body 32 is guided by the guide shafts 23, 24 under a condition that the wire 44 is effected with tension, and the embroidery frame 21*a* is moved to the normal direction of the X axis via the XY moving body 35. When the 1st motor 42 is rotated in the counterclockwise direction, the embroidery frame 21*a* is moved to the negative direction of the X axis opposite to the above direction. The control in the X direction of the embroidery frame 21*a* is made by the 1st motor 42, and the amount of control including the direction control is determined by the rotating direction, the rotating amount of the 1st motor 42 and the diameter of the pulley 43.

If the 2nd motor 55 and the 3rd motor 56 are tentatively fixed by the movement in the X direction of the embroidery frame 21*a*, the rotary bodies 40 and 41 are rotated by the wire 67, and the embroidery frame 21*a* is rotated via the wire 70 and the rotary member 38. Therefore, the control in the X direction is carried out, in addition to the rotation of the 1st motor 42, by rotating the 2nd motor 55 and the 3rd motor 56 in the same direction as the 1st motor by a certain angle in relation with the rotation angle of the 1st motor 42, such that the embroidery frame 21*a* is not rotated as a result of said control.

The control in the Y direction will be referred to with respect to FIG. 6. The embroidery frame 21*a* is controlled in the Y direction by fixing the 1st motor, and rotating the 2nd motor 55 and the 3rd motor 56 in opposite directions of each other by the same angle. The embroidery frame 21*a* is controlled in the positive direction in the direction of the Y axis by fixing the 1st motor 42, rotating the 2nd motor 55 by a certain angle in the positive direction, and rotating the 3rd motor 56 by the same angle in the negative direction. By this control, the upper parts of the wire 67 are coiled on the pulleys 57 and 58, and the lower parts thereof are uncoiled and the moving body 35 is guided by the guide shafts 33, 34 in the positive direction of the Y shaft together with the embroidery frame 21*a*. Since the wire 67 does not rotate the rotary body 40 at this controlling time, the embroidery frame 21*a* does not rotate but moves in the positive direction of the Y axis. The embroidery frame 21*a* is controlled in the negative direction in the direction of the Y shaft by fixing the 1st motor 42, rotating the 2nd motor 55 by a certain angle in the negative direction, and rotating the 3rd motor 56 by the same angle in the positive direction.

The embroidery frame 21*a* is controlled in the direction of the Y shaft as mentioned above, and under the above mentioned condition the amount of control including the direction is determined by the rotating direction and the rotating amount of either of the 2nd motor 55 and the 3rd motor 56, and the diameter of the pulleys 57, 58 of the equal diameter.

The control of the embroidery frame 21*a* will be explained with reference to FIG. 6. The embroidery frame 21*a* is rotated by fixing the 1st motor 42, and rotating the 2nd motor 55 and the 3rd motor 56 in the same direction and by the same angle in the same manner as in the control in the direction of the Y axis. When the 2nd motor 55 and the 3rd motor 56 are rotated in the positive direction and the same angle, the upper part of the wire 67 is coiled on the pulley 57, and the lower part thereof is coiled on the pulley 58. The rotary body 40 is reversely rotated while the moving body 35 remains stopped, and the embroidery frame 21*a* is rotated in the positive direction via the rotary body 41, the wire 70 and the rotary member 38. When the 2nd motor 55 and the 3rd motor 56 are rotated in the negative direction and by the same angle, the embroidery frame 21*a* is rotated in the negative direction.

The embroidery frame 21*a* is controlled as mentioned above. Under the above mentioned condition, the amount of control including the direction is determined by the rotating direction and the rotating amount of either of the 2nd motor 55 and the 3rd motor 56, the diameter of the pulleys 57, 58 of the equal diameter, the diameter of the rotary body 40 and reduction ratio of the embroidery frame 21*a* to the rotary body 40.

Holding of the fabric by the embroidery frame 21*a* is controlled in the X and Y directions and controlled with respect to the rotation, and the control of the embroidery frame 21*a* and the relation between the 1st motor 42 and the 2nd motor 55 is regulated.

If the amounts of controlling rotations of the 1st motor 42, the 2nd motor 55 and the 3rd motor 56 are expressed with variables Ⓗ 1, Ⓗ 2 and Ⓗ 3 respectively, and the controlling amounts of the X direction, the Y direction and the rotation control of the embroidery frame 21*a* are expressed with variables x, y and $\theta$ respectively, and if Ⓗ $1=0$, Ⓗ $2=\alpha$ and Ⓗ $3=-\alpha$ ($\alpha$: rotation angle) are given by the control in the direction of the Y axis, relative equations of $x=0$, $y=y1$ and $\theta=0$ are obtained. Herein, with respect to the value of y1, as seen from FIG. 6, if the radii of the pulleys 57, 58 are r1, $y1=r1$ is provided.

If Ⓗ $1=0$, Ⓗ $2=\alpha$ and Ⓗ $3=\alpha$ are given by the rotation control, relative equations of $x=0$, $y=0$ and $\theta=\theta1$ are obtained. Herein, the value of this $\theta$ is determined by the diameter of the pulleys 57, 58, the diameter of the rotary body 40 and reduction ratio of the embroidery frame 21*a* to the rotary body 40.

When Ⓗ $1=\alpha$, Ⓗ $2=0$ and Ⓗ $3=0$ are given by the control in the X direction, the relative equations of $x=x1$, $y=0$ and $\theta=\theta2$ are provided.

The value of x1, as seen in FIG. 9, is given by $x1=r_2\alpha/2$, assuming that the radius of the pulley 43 is $r_2$. The value of $\theta$ is obtained in that the rotary body 40 is rotated by the wire 67 in congruity with the movement in the X direction, and the relation with $\theta1$ is $$\theta 2 = -\frac{r2}{2r1}\theta 1.$$

Since these three movements are linear, vector $$\begin{pmatrix} x \\ y \\ \theta \end{pmatrix}$$

and vector $$\begin{pmatrix} H_1 \\ H_2 \\ H_3 \end{pmatrix}$$

are expressed with matrix.
From the above relative formula, $$\begin{pmatrix} x \\ y \\ \theta \end{pmatrix} = \begin{pmatrix} x_1/\alpha, & 0, & 0 \\ 0, & y_1/2\alpha, & -y_1/2\alpha \\ \theta_2/\alpha, & \theta_1/2\alpha, & \theta_1/2\alpha \end{pmatrix} \begin{pmatrix} H_1 \\ H_2 \\ H_3 \end{pmatrix}$$

and reverse matrix is obtained from the above mentioned matrix $$\begin{pmatrix} H_1 \\ H_2 \\ H_3 \end{pmatrix} = \begin{pmatrix} \alpha/x_1, & 0, & 0 \\ -\alpha\theta_2/x_1\theta_1, & \alpha/y_1, & \alpha/\theta_1 \\ -\alpha\theta_2/x_1\theta_1, & -\alpha/y_1, & \alpha/\theta_1 \end{pmatrix} \begin{pmatrix} x \\ y \\ \theta \end{pmatrix}$$

By the formula, the controlling amounts are obtained of the 1st motor 42, the 2nd motor 55 and the 3rd motor 56 to the controlling amounts x, y, $\theta$ of the embroidery frame.

As mentioned above, the embroidery frame 21*a* can be optionally controlled in the X direction, the Y direction and in rotation at the rotation phase where the needle is above the fabric, per each rotation of the upper shaft of the sewing machine. However, in the present invention, the rotation control is used only when the stitching direction is changed.

Figure 14:
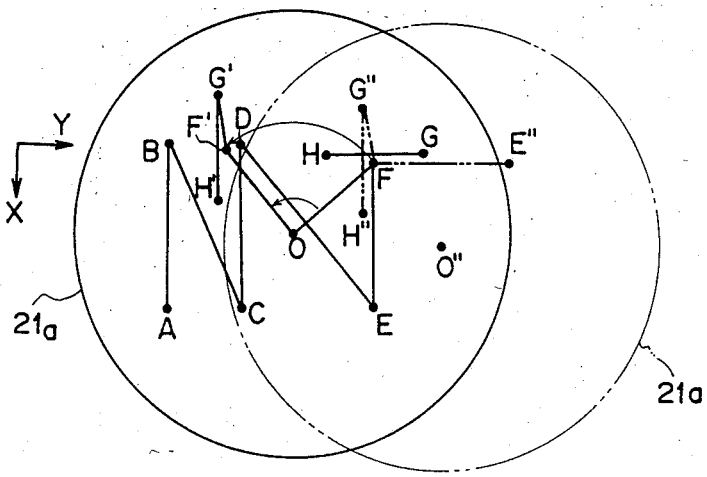
FIG. 14 is an explanatory view of forming the embroidering pattern.
Figure 15:
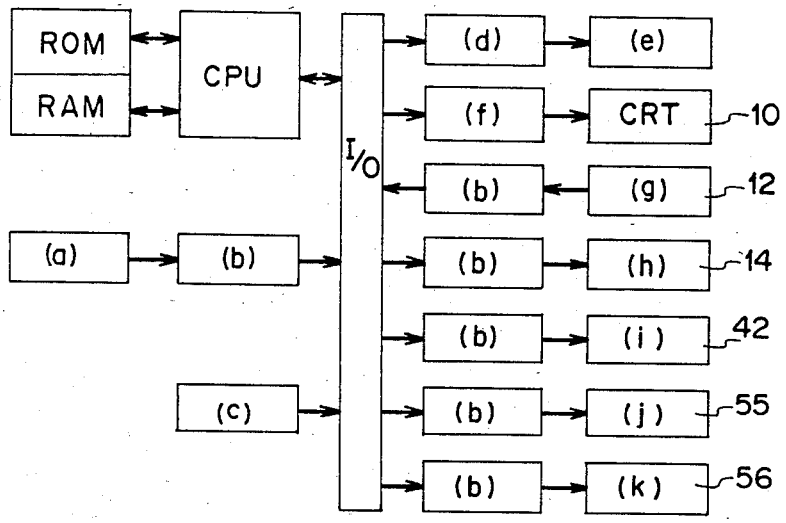
FIG. 15 is a block diagram of a control circuit.

Referring to FIG. 14, an explanation will be made to changing of the stitching direction. Assume that when the needle is positioned (amplitude is 0, and the same also in the following) at Point F on the fabric held by the embroidery frame 21*a*, the embroidery frame 21*a* is rotated around center Point O by angle $\theta$ (90° in FIG. 14) to change the stitching direction. When a coordinate of Point F is (X1, Y1), and it is rotated by the angle $\theta$, Point F is moved to a position F′, and when a coordinate of F′ is (X2, Y2), a new coordinate is given by a formula of $$\begin{pmatrix} X_2 \\ Y_2 \end{pmatrix} = \begin{pmatrix} \cos\theta, & -\sin\theta \\ \sin\theta, & \cos\theta \end{pmatrix} \begin{pmatrix} X_1 \\ Y_1 \end{pmatrix}$$

Since Point F is moved to Point F′ of the coordinate (X2, Y2), Points G, H on the fabric are moved to G′, H′, respectively, and the coordinate of the needle position is (X1, Y1), the embroidery frame 21*a* is necessarily moved with respect to the needle position. That is, the stitching direction is changed by the angle $\theta$ by rotating reversely the embroidery frame 21*a* around Point O as well as moving it in X direction by the amount of X1-X2 and moving it in Y direction by the amount of Y1-Y2.

The control in the direction of this stitch is a composite of the rotation control around Point O of the embroidery frame 21*a* and the rotations in the X and Y directions. These controls are analyzed for explaining convenience. Point F on the fabric is moved to Point F′ by the control of the embroidery frame 21*a*, and again returns to Point F. However, in the actual control, since the three motors 42, 55 and 56 are controlled simulataneously, Point F is not moved to Point F′, and the controlling result is the same condition as when the embroidery frame 21*a* is controlled around an optional point of the fabric held by the embroidery frame 21*a*.

The control in the direction of this stitching is borne by the three motors 42, 55 and 56, and this control is performed during stopping the sewing machine.

Controls in X and Y directions at high rotating speed are taken into consideration. When the embroidery frame 21*a* is controlled by X1 in the X direction, the control amounts of these three motors are $$H_1 = \alpha,\ H_2 = \frac{\alpha\theta_2}{\theta_1},\ H_3 = -\frac{\alpha\theta_2}{\theta_1}$$

That is, the control in the X direction is always borne by the three motors 42, 55, 56. When the embroidery frame 21*a* is controlled by y1 in the Y direction, the control amounts of the motors are $\textcircled{H}_1=0$, $\textcircled{H}_2=\alpha$, $\textcircled{H}_3=-\alpha$ from formula (1), and the control in the Y direction is always borne by the two motors 55, 56.

Actuation of an embodiment of the invention will next be explained. Stitching position of an embroidering pattern with respect to the embroidery frame 21*a* is determined by a key operating portion 12 via CRT display 10. This is to carry out a display treatment that the embroidery frame 21*a* is illustrated on the CRT display showing 10 letters or numerals to be embroidered and positiond as desired thereto. Detailed explanation is omitted herein. Many kinds of pattern data stored in the floppy disc are read out via the display treatment by means of the key operating portion 12, and are converted into coordinate data corresponding to arrangement on the embroidery frame, so that such preparations are made by advancing addresses to read out in succession the data at an initial position of the pattern (data in X and Y directions, data for controlling rotation, data for zigzag motor), a plurality of pattern data following said data, data at an initial position of subsequent pattern, and a plurality of pattern data following said data, and on the other hand at the same time, to carry out editing operation including a speed control signal and a stopping signal for stopping the sewing machine at controlling the rotation of the embroidery frame 21*a*.

Figure 1:
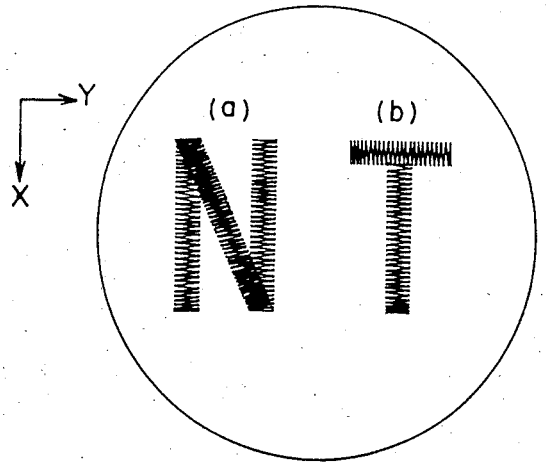
FIG. 1 shows examples of stitchings of embroidering patterns.
Figure 2:
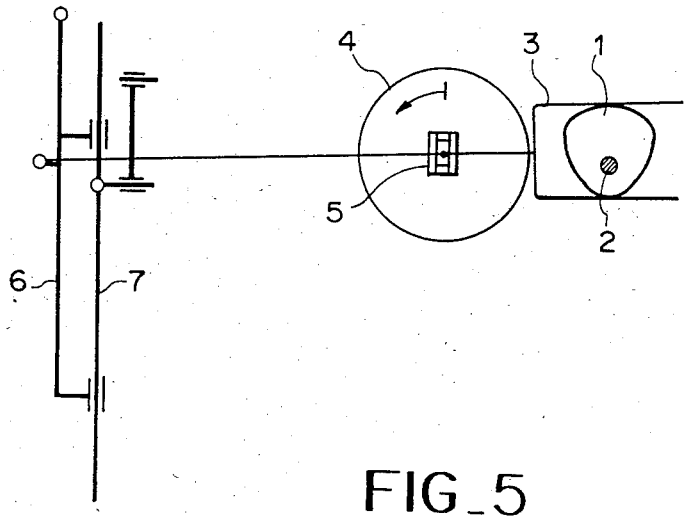
FIG. 2 is an outlined view of a zigzag generator of an automatic embroidery sewing machine.

A further description will refer to embroiderings of N and T within the embroidery frame 21*a* as shown in FIG. 1. Pattern data including the stopping signals and the speed control signals are arranged within the memory by said editing operation. When a button in the key operating portion 12 and the automatic embroidery machine is started, the embroidery frame 21*a* is driven by the 1st motor 42, the 2nd motor 55 and the 3rd motor 56, and when the needle position (at the amplitude 0, the same also in the following) is controlled to be at Point A and the zigzag motor 14 is controlled. Thus, the initial setting is made. The speed control circuit is at high speed, and the address is advanced per each of the stitches and output signals are issued to the motors at the phase where the needle is above the fabric. As a result, fine controls are continued to the embroidery frame to move the needle position in order of Point A, Point B, Point C and Point D, so that a letter of "N" is stitched in combination with zigzag stitching, and the sewing machine is stopped at the phase where the needle is above the fabric.

With respect to a letter of "T", the initial position is read out similarly to drive each of the motors, and the needle position is set to be at Point E and the zigzag motor 14 is controlled. The speed control circuit is at high speed, and the address is advanced per each of the stitches. As a result, fine controls are continued to the embroidery frame to move the needle position from Point E to Point F, so that a standing portion of the letter "T" is stitched in combination with zigzag stitching, and the sewing machine is stopped at the phase where the needle is above the fabric. The stitching direction is changed by turning the embroidery frame 21*a* 90° and moving it in X and Y directions simultaneously and turning the embroidery frame 21*a* 90° around Point F (under this condition the center of the embroidery frame 21*a* is Point O″), and moving it in X and Y directions so that the needle position is moved to Point G″ relatively. Subsequently, fine control in X direction is made to the embroidery frame 21*a* per each of stitches so that the needle position is moved from Point G″ to Point H″ relatively, and a lateral portion of the letter "T" is stitched in combination with the zigzag stitching. When the sewing machine is stopped at the phase where the needle is above the fabric, "N" and "T" are stitched as shown in FIG. 1.

It will be understood that each of the elements described above, or two or more together, may also find a useful application in other types of sewing machines differing from the types described above.

While the invention has been described and illustrated in a zig-zag sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting feabures that, from the standpoint of prior art, fairly constitute essential characteristics of the generic or specific aspects of this invention.

What is claimed as new and desired to be protected by Letters Patent is set forth in the appended claims:

1. An embroidery frame drive device used in combination with zigzag sewing machine having a needle which is laterally swingable and vertically reciprocated to form embroidery stitches on a fabric clamped by an embroidery frame, said drive device comprising:

a base plate; first and second movable means and mounted on said base plate; first, second guide means, said first guide means being adapted to guide said first and second movable means in one direction and said second guide means being adapted to guide said second movable means in a direction transversely of said one direction; support means including an elongated support member having one end secured to said second movable means and the other end supporting said embroidery frame; means operatively connected to said embroidery frame to rotate the latter; first, second and third electromagnetic actuators, each secured to said base plate, and first, second and third transmission means, said first transmission means being operatively connected between said first electromagnetic actuator and said first, and second movable means, said first electromagnetic actuator being driven in one direction to operate said first transmission means to thereby move said first and second movable means along said first guide means, said second transmission means being operatively connected between said second and third electromagnetic actuators and said second movable means, said second and third electromagnetic actuators being driven under independent control to operate said second transmission means to thereby move said second movable means along said second guide means, said third transmission means being operatively connected between said second and third electromagnetic actuators and said embroidery frame rotating means by way of said second transmission means, said second and third electromagnetic actuators being driven to operate said third transmission means to thereby rotate said embroidery frame rotating means.

2. An embroidery frame drive device as defined in claim 1, wherein said first, second and third transmission means include a plurality of wires, and said second and third electromagnetic actuators are connected in series by one of said wires.

* * * * *